US006920904B2

(12) United States Patent
Yquel

(10) Patent No.: US 6,920,904 B2
(45) Date of Patent: Jul. 26, 2005

(54) DEVICE FOR PACKAGING AND DISPENSING AT LEAST TWO PRODUCTS

(75) Inventor: Jean-Pierr Yquel, Colombes (FR)

(73) Assignee: L'Oreal S.A., Paris (FR)

( * ) Notice: Subject to any disclaimer, the term of this patent is extended or adjusted under 35 U.S.C. 154(b) by 309 days.

(21) Appl. No.: 10/141,605

(22) Filed: May 9, 2002

(65) Prior Publication Data

US 2002/0185501 A1 Dec. 12, 2002

(30) Foreign Application Priority Data

May 9, 2001 (FR) ..... 01 06127

(51) Int. Cl.[7] ..... B65B 1/04
(52) U.S. Cl. ..... 141/3; 141/20; 222/402.18
(58) Field of Search ..... 141/20, 3, 113; 222/145.5, 402.18, 386.5, 148, 136; 137/223

(56) References Cited

U.S. PATENT DOCUMENTS

| | | | |
|---|---|---|---|
| 3,232,493 | A | 2/1966 | Beard, Jr. |
| 3,236,457 | A | 2/1966 | Kennedy et al. |
| 3,326,416 | A | 6/1967 | Hayes |

(Continued)

FOREIGN PATENT DOCUMENTS

| | | | |
|---|---|---|---|
| DE | 29 16 699 | | 11/1979 |
| EP | 0227049 | A2 * | 7/1987 |
| EP | 0 243 667 | | 11/1987 |
| EP | 0 313 414 | | 4/1989 |
| EP | 0 427 609 | | 5/1991 |
| EP | 0 709 305 | | 5/1996 |
| FR | 1 413 164 | | 8/1965 |
| FR | 2 133 112 | | 11/1972 |
| FR | 2 598 392 | | 11/1987 |
| FR | 2 637 870 | | 4/1990 |
| FR | 2 679 880 | | 2/1993 |
| FR | 2 732 245 | | 10/1996 |
| GB | 1 163 978 | | 9/1969 |
| JP | T-S50-11091 | | 4/1975 |
| JP | A-S64-39288 | | 3/1989 |
| JP | A-H8-175578 | | 7/1996 |
| JP | A-H8-192880 | | 7/1996 |

OTHER PUBLICATIONS

Co–pending U.S. Appl. No. 09/773,694; Title: Dispenser for Selectively Dispensing Separately Stored Components, Inventor(s): Jean–Pierre Yquel, filed Feb. 2, 2001.
English Language Derwent Abstract of EP 0 427 609, May 15, 1991.
English Language Derwent Abstract of FR 2 732 245, Oct. 4, 1996.
English Language Derwent Abstract of FR 2 679 880, Feb. 5, 1993.

*Primary Examiner*—Khoa D. Huynh
(74) *Attorney, Agent, or Firm*—Finnegan, Henderson, Farabow, Garrett & Dunner, LLP

(57) ABSTRACT

A device includes a first container, a second container arranged at least partially inside the first container, a dispensing valve including an outlet, and a one-way valve disposed between the first compartment and the second compartment. At least one of the first container and the second container defines a first compartment configured to contain a pressurized first product and a second compartment configured to contain a pressurized second product isolated from the first product. The dispensing valve is configured to be actuated and is configured to selectively enable at least one of the first product and the second product to flow to the outlet in response to actuation of the dispensing valve.

64 Claims, 18 Drawing Sheets

U.S. PATENT DOCUMENTS 3,326,469 A * 6/1967 Abplanalp et al. ..... 239/308
3,406,877 A * 10/1968 Frangos ..... 222/402.1
3,525,997 A 8/1970 O'Donnell
3,543,965 A 12/1970 Lehmann et al.
3,568,888 A 3/1971 Baldoni et al.
3,592,359 A * 7/1971 Marraffino ..... 222/94
3,592,361 A 7/1971 Marand
3,612,361 A 10/1971 Ewald
3,642,173 A 2/1972 Marraffino
3,720,376 A 3/1973 Morane et al.
3,770,165 A 11/1973 Steiman et al.
3,796,352 A 3/1974 Morane
3,869,070 A * 3/1975 Schmoegner et al. ..... 222/635
3,894,659 A 7/1975 Focht
3,976,223 A 8/1976 Jass et al.
4,328,843 A * 5/1982 Fujii ..... 141/1
4,431,119 A 2/1984 Stoody
4,750,647 A * 6/1988 Cohen ..... 222/386.5
4,792,062 A 12/1988 Goncalves
4,826,048 A 5/1989 Skorka et al.
4,969,584 A 11/1990 Joulia
5,167,347 A 12/1992 Wiegner et al.
5,411,183 A * 5/1995 Hildebrandt ..... 222/399
5,579,955 A * 12/1996 Sandou-Pascal et al. .... 222/105
5,695,096 A 12/1997 Yquel
6,607,012 B2 * 8/2003 Yquel ..... 141/20

* cited by examiner

DEVICE FOR PACKAGING AND DISPENSING AT LEAST TWO PRODUCTS

The present invention relates to a device for packaging and dispensing at least two products. The products may be stored separately and dispensed individually or simultaneously as a mixture. Examples of products that may be used include cosmetic products, such as hair products. Such products may include hair dyes and/or perming solutions.

One application, for example, may relate to hair dyeing products that result from the extemporaneous mixing of a dye and an oxidizing agent. In this example, the dye and the oxidizing agent may be dispensed from the device simultaneously.

Another application, for example, may relate to permanent solutions that utilize the successive application of two products, such as a permanent reducing agent (e.g., thioglycolic acid) and a fixing agent.

Conventional devices in the field of hair dyeing may include dispensing units for simultaneously and separately dispensing two products from two containers in which these products are stored separately. These dispensing units may comprise a body and a push button that can be moved with respect to the body. Each container may be provided with a valve comprising a hollow actuating stem that is depressed to cause the product to be dispensed. A dispensing unit such as this is described in French Patent application FR-A-2 732 245.

One difficulty with at least some such dispensing units may relate to the inability to identically pressurize the two containers, making it difficult for the two products to be dispensed in a clearly defined ratio, such as, for example, 1:1. Such a precise ratio between the dye and the oxidizing agent may be desired in the application of a hair dye product. Furthermore, the actuating stems may have upper ends which are not situated at exactly the same level due to manufacturing tolerances, which may lead to a risk of non-simultaneous dispensing of the products.

In addition, conventional devices may not allow the products to be dispensed one after another, as may be desired in the application of a perming product.

Finally, because of their complexity, conventional devices may be relatively expensive and may take up a relatively large amount of space, leading to difficulties in storage and handling of the devices.

Other dispensing units have been proposed, but at least some of those units may have one or more of the problems identified above. Examples of these dispensing units are found in U.S. Pat. No. 3,236,457, European patent applications EP-A-0 313 414, EP-A-0 427 609, and EP-A-0 243 667, British patent GB 1 163 978, and French patent applications FR-A-2 598 392 and FR-A1 413 164.

In another example, U.S. Pat. No. 3,232,493 describes a pressurized device in which the product to be dispensed is packaged separately from the gas which propels it. The product is separated from the propellant by a membrane having a slit, which opens in response to a pressure differential. Each time the slit opens, gas enters the compartment containing the powder so as to pressurize it and force it out. The product is therefore packaged separately from the propellant only in the absence of an actuation.

With such an arrangement disclosed in that reference, when the pressure increases inside the compartment containing the product that is to be dispensed (e.g., following a sharp increase of temperature), the pressurized product may move into the compartment containing the propellant.

The present invention may fully or partially obviate one or more limitations of the related art. For example, the present invention may provide a device for the separate packaging of at least two products and for dispensing them simultaneously or one after the other. In addition, the present invention may provide a device which occupies a small amount of space, is economical to produce, and simple to use. Further, the present invention may provide a device which dispenses a precise ratio of one of the products with respect to the other when used for the simultaneous dispensing of two products. It should be understood that the invention could be practiced without performing one or more of the objects and/or advantages described herein. Other objects and advantages of the invention may become apparent from the description which follows.

The present invention is described by referring to a number of aspects and embodiments. It should be understood that these aspects and embodiments are exemplary and that the invention could be practiced without necessarily having all of the features of the aspects and embodiments described herein.

As embodied and broadly described herein, one aspect of the invention may include a device comprising a first container, a second container arranged at least partially inside the first container, a dispensing valve comprising an outlet, and a one-way valve disposed between the first compartment and the second compartment. At least one of the first container and the second container may define a first compartment configured to contain a pressurized first product and a second compartment configured to contain a pressurized second product isolated from the first product. The dispensing valve may be configured to be actuated and may be configured to selectively enable at least one of the first product and the second product to flow to the outlet in response to actuation of the dispensing valve.

In an exemplary embodiment, the one-way valve may be associated with the second container. Optionally, the one-way valve may be configured to permit flow into the second compartment.

According to an aspect of the invention, the first container may comprise an orifice associated with a closure configured to permit pressurization of the first compartment and pressurization of the second compartment via the one-way valve. In an exemplary embodiment, the closure may comprise an elastomer plug. The plug may allow the passage of a needle to pressurize the first compartment. For example, the needle may pass through the plug to enter the first compartment and add propellant. Once the needle has been withdrawn, the plug may close up again in a sealed manner due to the elasticity of the material.

In another aspect of the invention, the one-way valve may comprise a shutter. In an exemplary embodiment, the shutter may comprise an elastically deformable material. In a further exemplary embodiment, the elastically deformable material may be chosen from thermoplastics and cross-linked elastomers.

In further aspect of the invention, the first compartment may be defined by the first container and the second container, and the second compartment may be defined by the second container. In an exemplary embodiment, the first compartment may surround the second container over at least part of its height. Because one of the containers may be arranged at least partially inside the other, the space occupied by the device may be reduced appreciably by comparison with that of at least some conventional devices.

In a further exemplary embodiment, the one-way valve may be configured to permit flow into the second compartment. This configuration may be utilized, for example, where the products are heavier than the propellant that pressurizes them. In such a case, pressurization of the first compartment via the second compartment may be more difficult to achieve.

The one-way valve may allow the pressure inside the second compartment to be roughly equal to the pressure inside the first compartment. Furthermore, the valve may prevent the product contained in the second compartment from entering the first compartment and being brought into contact with the product it contains.

The second compartment may be pressurized via the first compartment and this may make it possible to ensure equilibrium or near equilibrium of pressures between the first and second compartments. In the case of simultaneous dispensing of the two products, it may be possible to ensure a precise ratio of one of the products with respect to the other.

According to an aspect of the invention, the dispensing valve may be configured to permit the outlet to be substantially simultaneously in flow communication with both the first compartment and the second compartment. This configuration may be desirable in the case of simultaneous dispensing of the two products contained in the device.

In the case of successive dispensing of the two products, substantially simultaneous communication between the outlet passage and the first and second compartments may, at the same time as one of the products is let out, cause propellant gas contained in the compartment containing the other product to come out. If this release of propellant is not desired, it may be possible to provide offset communication between the outlet passage and the first and second compartments. A valve with such an offset method of communication is described in European patent application EP-A-0 709 305.

In another aspect, the dispensing valve may be configured to enable both the first product and the second product to flow to the outlet substantially simultaneously. The dispensing valve may also be configured to enable one of the first product and the second product to flow to the outlet.

To obtain the desired dispensing ratio of the products, the passages through which the first product and/or the second product flow may be configured in an appropriate manner. In one example, the viscosity of each of the products may be taken into account.

In an aspect of the invention, the dispensing head for actuating and dispensing the product may be greatly simplified in comparison with the dispensing head of at least some conventional devices.

In one exemplary embodiment, the dispensing valve may be flow coupled to a dip tube comprising a free end arranged proximate to a bottom of the first container. With this configuration, and assuming that the second container has no dip tube, it may be possible, when the device is in the head-up position, to dispense the product contained in the first compartment, for example, a perming reducing agent. Next, by inverting the container into the head-down position, the product contained in the second compartment, for example, a fixing agent, may be dispensed.

In another exemplary embodiment, the dip tube may be a first dip tube, and the dispensing valve may be flow coupled to a second dip tube comprising a free end arranged proximate to a bottom of the second container. With this configuration, and assuming that the first container has no dip tube, it may be possible, when the device is in the head-up position, to dispense the product contained in the second compartment, for example, the perming reducing agent. Next, by inverting the container into the head-down position, the product contained in the first compartment, for example, the fixing agent, may be dispensed.

In the case, for example, where each of the two compartments is associated with a dip tube, it may be possible, with the device in the head-up position, to dispense the two products (for example, a dye and an oxidizing agent) simultaneously.

In another case, for example, where neither of the two compartments is associated with a dip tube, it may be possible, with the device in the head-down position, to dispense the two products (for example, a dye and an oxidizing agent) simultaneously.

In another aspect, the dispensing valve may comprise an actuatable element (e.g., nozzle) configured to move between a first position and a second position in response to an actuating force. The valve may comprise a push-down type of valve.

According to an exemplary embodiment, the dispensing valve may be configured so that when the actuatable element is in the first position, the outlet is sealed off from the first compartment and the second compartment, and, when the actuatable element is in the second position, the outlet is in flow communication with the first compartment and the second compartment.

In another exemplary embodiment, the dispensing valve may be configured so that as the actuatable element is moved from the first position to the second position, the outlet is simultaneously or successively placed in flow communication with the first compartment and the second compartment.

According to a further aspect, the dispensing valve may further comprise a valve body and the actuatable element may comprise a piston configured to slide axially inside the valve body, the piston separating a first axial portion of the valve body from a second axial portion of the valve body. The second axial portion of the valve body may be in flow communication with the second compartment. In an exemplary embodiment, the piston may be secured to a valve stem comprising at least a portion extending from the valve body. The piston may comprise a unitary piece with the valve stem or may at least partially comprise an attached part.

According to a still further aspect, the dispensing valve may be configured so that when the actuatable element is in the first position, the first axial portion of the valve body and the second axial portion of the valve body are sealed off from one another.

In an exemplary embodiment, the outlet may comprise an outlet passage passing through the valve stem. In a further exemplary embodiment, the outlet may comprise an outlet orifice at an end of the valve stem.

In another aspect, the dispensing valve may be configured so that when the actuatable element is in the first position, a sealing element associated with the piston seals off at least one orifice passing through a wall of the valve body and opening into the first compartment.

In yet another aspect, the dispensing valve may be configured so that when the actuatable element is in the first position, the sealing element further seals off the first axial portion of the valve body from the second axial portion of the valve body. In an exemplary embodiment, the sealing element may comprise at least one of a lip and a seal. The sealing element of the piston may comprise a material identical to the material of which the remainder of the nozzle is formed, or it may comprise a separate material. In the latter case, the sealing element may be either attached, formed by two-shot injection molding, or overmolded, for example.

According to a further aspect, the dispensing valve may be configured so that when the actuatable element is in the second position, the at least one orifice passing through the wall of the valve body is uncovered so as to allow flow communication between the first axial portion of the valve body and the first compartment.

In a still further aspect, the dispensing valve may be configured so that when the actuatable element is in the second position, the first axial portion of the valve body and the second axial portion of the valve body are in flow communication.

In yet another aspect, the dispensing valve may be configured so that when the actuatable element is in the second position, the first axial portion of the valve body and the second axial portion of the valve body communicate via at least one axial groove formed in an internal wall of the valve body.

In an exemplary embodiment, the device may further comprise an actuator (e.g., diffusing member) configured to actuate the dispensing valve. In another exemplary embodiment, the actuator may comprise at least one orifice configured to dispense, separately or as a mixture, the first product and the second product. In a further exemplary embodiment, the actuator may comprise a push button.

According to an aspect of the invention, the first container and the second container may comprise metal. In an exemplary embodiment, the metal may be chosen from tin plate and aluminum.

According to another aspect of the invention, the first container and the second container may comprise a thermoplastic material. In an exemplary embodiment, the thermoplastic material may be chosen from polyvinyl chloride, polyethylene terephthalate, and a polyethylene terephthalate/polyethylene naphthalate blend. The two containers may be made of the same material or of different materials.

According to yet another aspect of the invention, the dispensing valve may be mounted on the first container. In an exemplary embodiment, the dispensing valve may be mounted on the first container by at least one of crimping and expansion rolling.

According to a further aspect of the invention, the second container may be secured to the dispensing valve. In an exemplary embodiment, the second container may be secured to the dispensing valve by at least one of bonding, welding, snap-fastening, and crimping.

In a still further aspect, the device may further comprise a first product in the first compartment and a second product in the second compartment. In an exemplary embodiment, a free surface of the first product may be spaced from the one-way valve when the device is in a head-up position. In another exemplary embodiment, at least one of the first product, the second product, and a mixture of the first and second products may comprise a cosmetic product.

In yet another exemplary embodiment, one of the first and second products may comprise a dye, the other of the first and second products may comprise an oxidizing agent, and a mixture of the first and second products may comprise a hair dye product.

In a further exemplary embodiment, one of the first and second products comprises a permanent wave reducing agent and the other of the first and second products comprises a permanent wave fixing agent.

In an aspect of the invention, the first product in the first compartment may be pressurized and the second product in the second compartment may be pressurized. In another aspect, the device may further comprise propellant in the first compartment pressurizing the first product and propellant in the second compartment pressurizing the second product. Optionally, the pressure of the first product in the first compartment may be substantially the same as or higher than pressure of the second product in the second compartment.

In another aspect, the device may be configured so that when the device is in a head-up position, one of the first and second products passes to the outlet in response to actuation of the dispensing valve, and when the device is in a head-down position, the other of the first and second products passes to the outlet in response to actuation of the dispensing valve.

In another aspect, the device may be configured so that when the device is in at least one of a head-up position and a head-down position, both the first and second products pass to the outlet in response to actuation of the dispensing valve.

A still further aspect of the invention relates to a method for packaging at least two products, comprising providing the device, placing a first product into the first compartment, placing a second product into the second compartment, and pressurizing the first compartment and the second compartment via one of the first compartment and the second compartment.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

In an exemplary embodiment, the pressurizing may comprise introducing propellant into the first container, wherein the propellant passes from the first container to the second container via the one-way valve.

Another aspect relates to a dispensing method including providing the device and actuating the dispensing valve so as to dispense at least one of the first product and the second product.

In an exemplary embodiment, the dispensing method may further comprise dispensing both the first product and the second product substantially simultaneously. In another exemplary embodiment, the dispensing method may further comprise dispensing one of the first product and the second product, and dispensing the other of the first product and the second product.

In yet another exemplary embodiment, the dispensing method may further comprise dispensing one of the first product and the second product and dispensing the other of the first product and the second product after at least some of said one of the first product and second product has been dispensed.

According to one aspect, one of the first product and the second product may comprise a dye, the other of the first product and the second product may comprise an oxidizing agent, and a mixture of the first and second products may comprise a hair dye product.

According to another aspect, one of the first product and the second product may comprise a permanent wave reducing agent and the other of the first product and the second product may comprise a permanent wave fixing agent. In an exemplary embodiment, at least a portion of the permanent wave reducing agent may be dispensed before the permanent wave fixing agent.

According to yet another aspect, at least one of the first product, the second product, and a mixture of the first and second products may comprise a cosmetic product, and the dispensing method may comprise dispensing the cosmetic product.

In an exemplary embodiment, the dispensing method may further comprise dispensing the cosmetic product onto at least one of hair, skin, a finger nail, and a toe nail. In another exemplary embodiment, the dispensing method may further comprise dispensing the cosmetic product onto an applicator and applying the cosmetic product to at least one of hair, skin, a finger nail, and a toe nail using the applicator.

The accompanying drawings are included to provide a further understanding of certain aspects of the invention and are incorporated in and constitute part of the specification.

Figure 1:
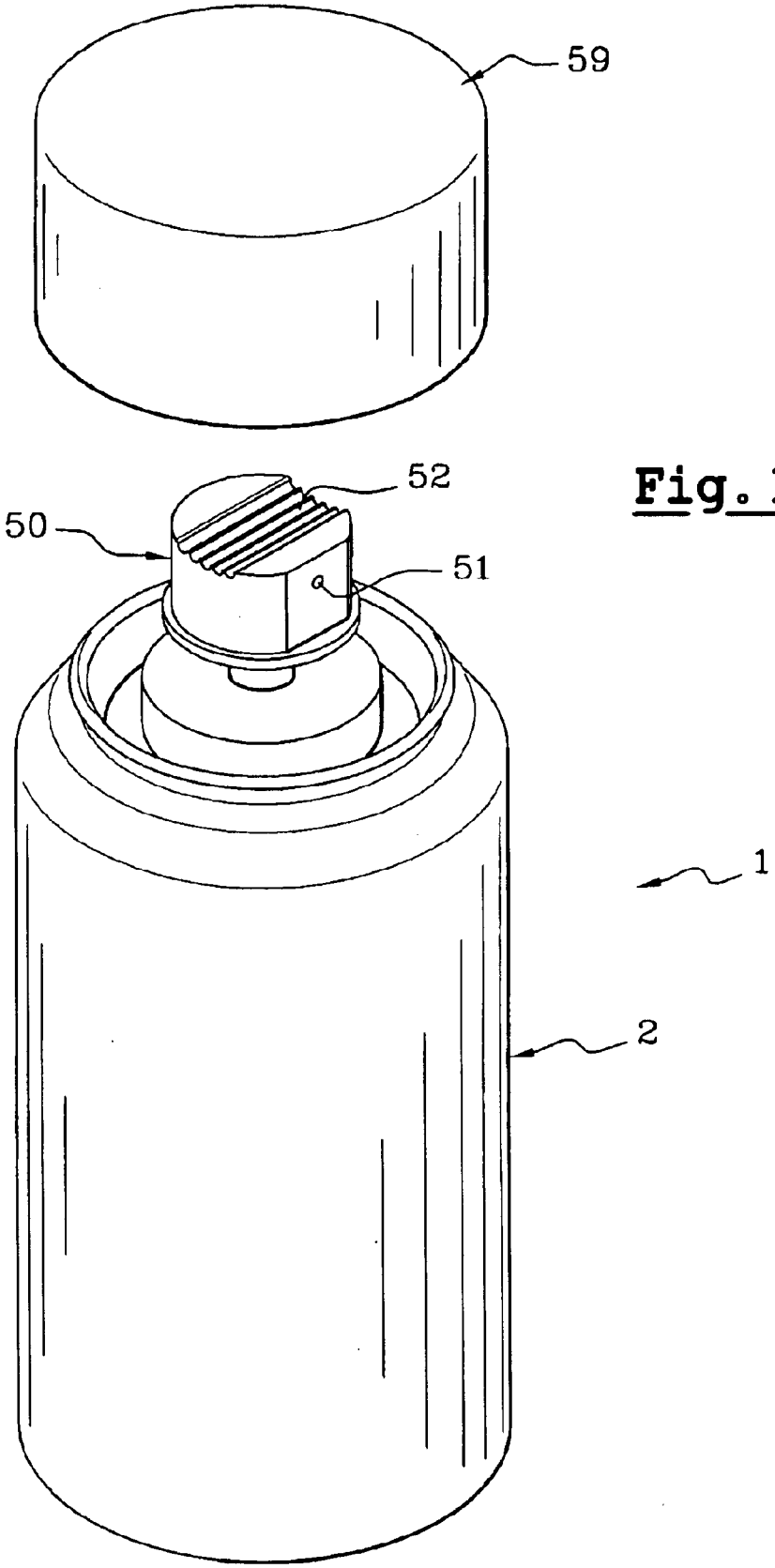
FIG. 1 is a perspective view of a device according to an exemplary embodiment of the invention.

The device 1 shown in FIG. 1 comprises a cylindrical container 2 having an actuator (e.g., dispensing head) 50 for actuating a dispensing valve 5 (described in detail below) to dispense a composition, such as, for example, a hair composition, through a dispensing orifice 51. A removable cap 59 covers the dispensing head 50.

In one embodiment, which will be described specifically with reference to FIGS. 2, 3A–3E, and 4A–4B, the device 1, having a longitudinal axis X, comprises an outer container 2 made of aluminum. Other materials may also be used. Crimped onto the open edge of the outer container 2 is the dispensing valve 5.

The dispensing valve 5 comprises a valve body 6, one end of which is closed by a seal 7 through which an axial orifice 8 passes. Inside the valve body 6 there is an actuatable element 10 (e.g., nozzle) comprising a piston 11 which, in the closed position (FIG. 2), seals off the upper part 12 of the valve body 6 from the lower part 13 of the valve body 6. The nozzle 10 is forced into the closed position by means of a spring 18. One end of the spring 18 rests on the piston 11 and the other end rests on the bottom of the valve body 6, as shown.

The nozzle 10 comprises a valve stem 19 secured to the piston 11. A tubular part of the valve stem 19 emerges from the valve body 6. The valve stem 19 has a duct 20 passing axially through it to define a valve outlet passage. One end of the duct 20 opens radially via a lateral orifice 21 which, when the valve 5 is in the rest position, faces the seal 7.

The dispensing head 50 is press-fitted onto the valve stem 19. The dispensing head 50 comprises a bearing surface 52. A duct 53 passes through the dispensing head 50 and is in communication with the duct 20 of the valve stem 19. One end of the duct 53 communicates with the dispensing orifice 51. The dispensing orifice 51 may be formed in an outlet nozzle, for example, of the swirl-inducing duct type. Outlet nozzles having other shapes may also be used.

When the valve is in this closed position, an annular bulge 14, formed by the piston 11, faces an orifice 15 passing through a side wall 16 of the valve body. The orifice 15 opens at one end into the outer container and at the other end into the valve body 6. Thus, the valve body 6 is isolated from the outer container.

Further, in this position the annular bulge 14 is above the upper end of one or more grooves 17, running axially over the internal surface of the side wall 16 of the valve body. Thus, the upper part 12 of the valve body is isolated from the lower part 13. The upper end of the groove (or grooves) 17 is arranged slightly below the orifice 15. The difference in level between the upper end of the groove or grooves 17 and the orifice 15 corresponds to approximately half the axial height of the annular bulge 14.

The valve body 6, at an end opposite to the seal 7, comprises a bottom open at its center and connected to an axial hollow shaft 22. The axial hollow shaft is open at its two ends. On its exterior surface the shaft 22 has a bulge 23 able to engage in snap-fastening with a groove 33 formed on the internal surface of the neck of an inner container 30.

The inner container 30 has an axial height considerably shorter than the axial height of the outer container 2, so that the bottom 31 of the inner container 30 is distant from the bottom 24 of the outer container 2. The inner container 30 has an external cross section smaller than the internal cross section of the outer container 2. Thus, the outer container 2 and the inner container 30 define a first compartment 40 formed, over part of its height, around the inner container 30, and a second compartment 41 defined inside the inner container 30.

The first compartment 40, in this embodiment, contains an oxidizing agent (for example, a solution based on hydrogen peroxide). The second compartment 41 contains a dye. Other products may also be used.

The bottom 31 of the inner container 30 has an orifice in which there is mounted a shutter 32. The shutter 32 opens one way towards the inside of the inner container 30 when the pressure outside the inner container 30 exceeds the internal pressure of the inner container 30. The shutter 32 is made, for example, of silicone. Other materials compatible with the products contained in the compartments 40 and 41 may also be used.

The bottom 24 of the outer container 2 has an orifice in which a closure element, for example, in the form of a rubber plug 25, is mounted. The plug 25 is configured to permit a hollow needle to be passed therethrough so as to pressurize the compartments 40 and 41. After pressurization, when the needle is withdrawn from the plug 25, the plug automatically reseals under the elastic return force exerted by the material of which the plug 25 is made.

Figure 2:
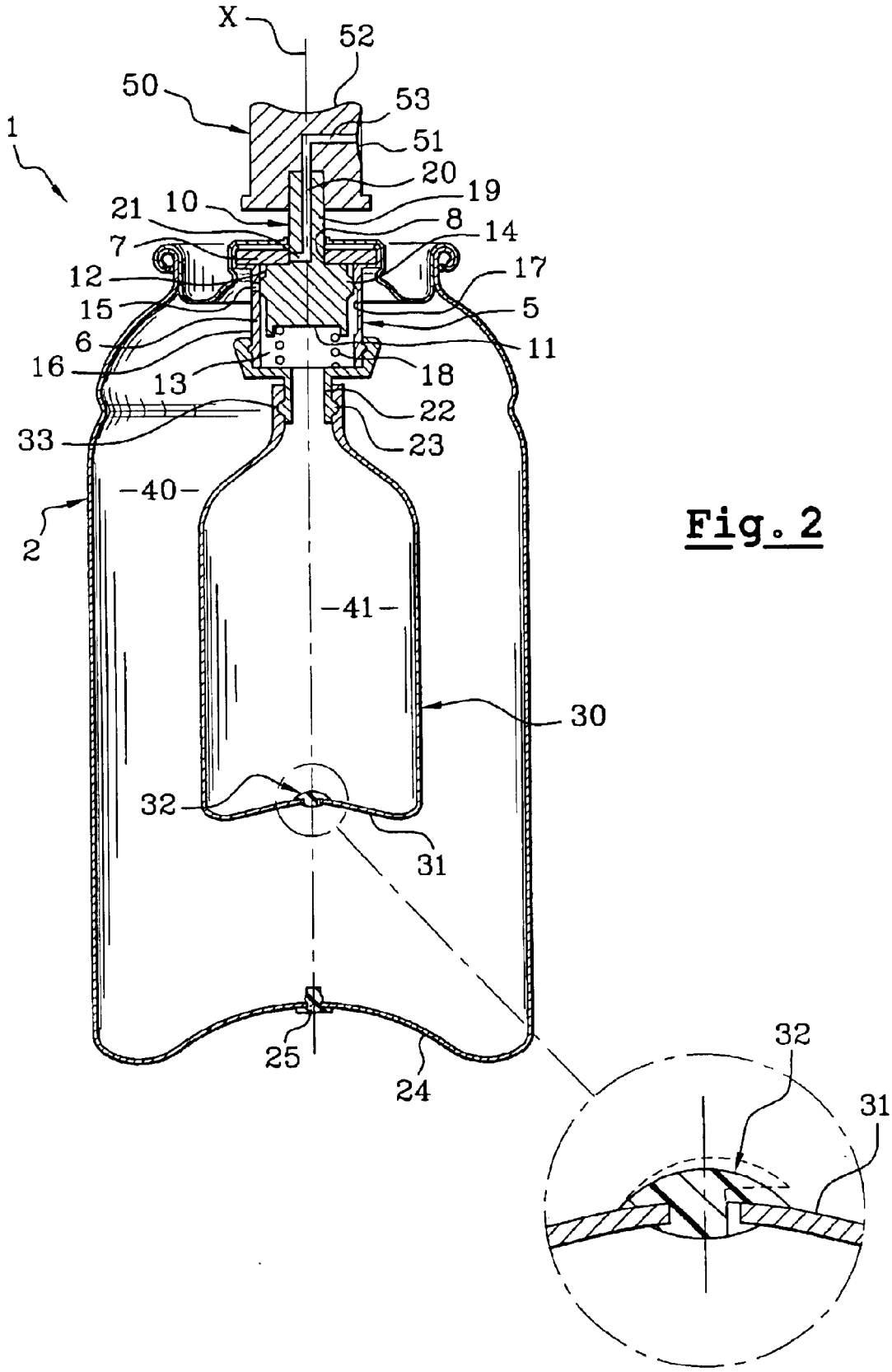
FIG. 2 is a cross-sectional view of the device of FIG. 1.

The assembly and filling of the device described in FIG. 2 will now be described with reference to FIGS. 3A–3E.

Figure 3A:
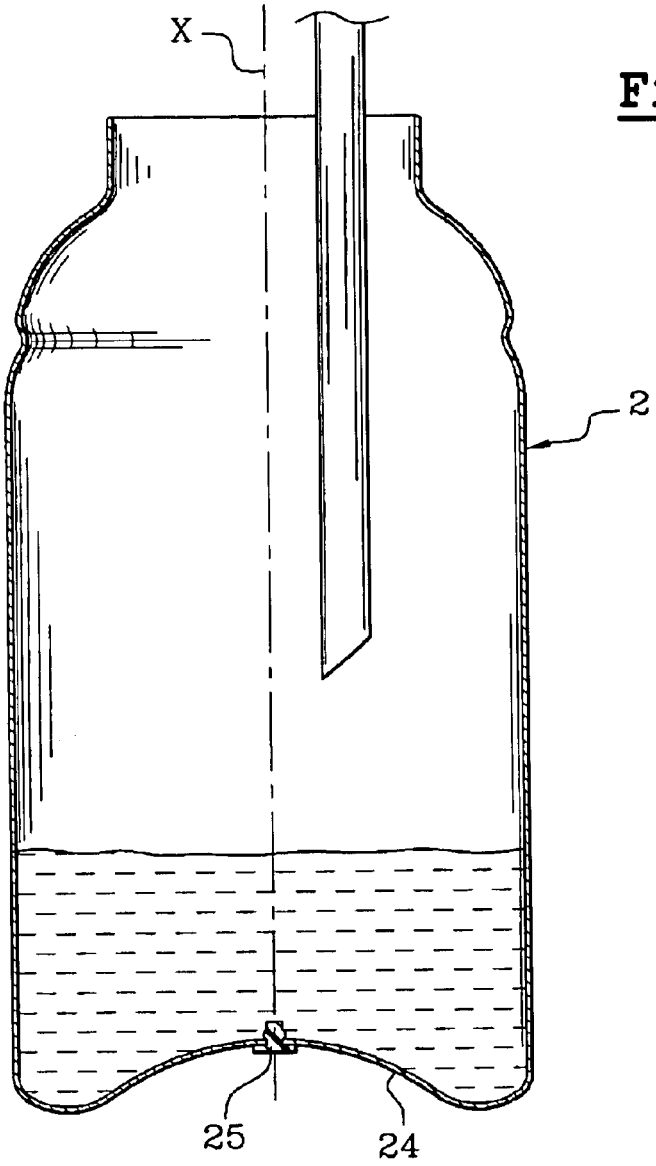
FIGS. 3A–3E are cross-sectional views illustrating the filling and assembly of the device of FIG. 1.

In FIG. 3A, the first product is introduced into the outer container 2 through its open end.

Figure 3B:
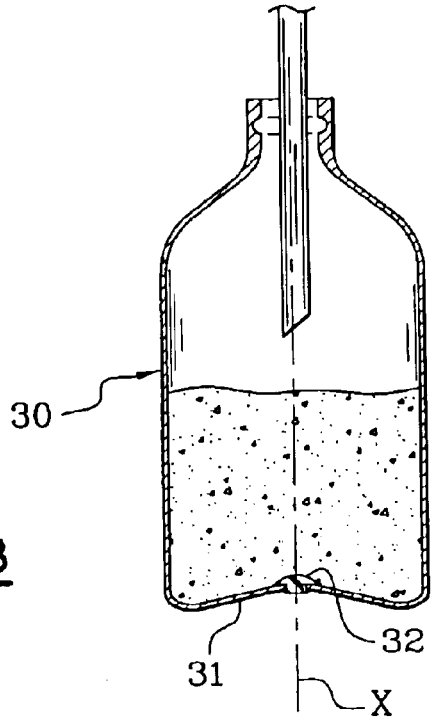

In FIG. 3B, the second product is introduced into the inner container 30 through its open end.

Figure 3C:
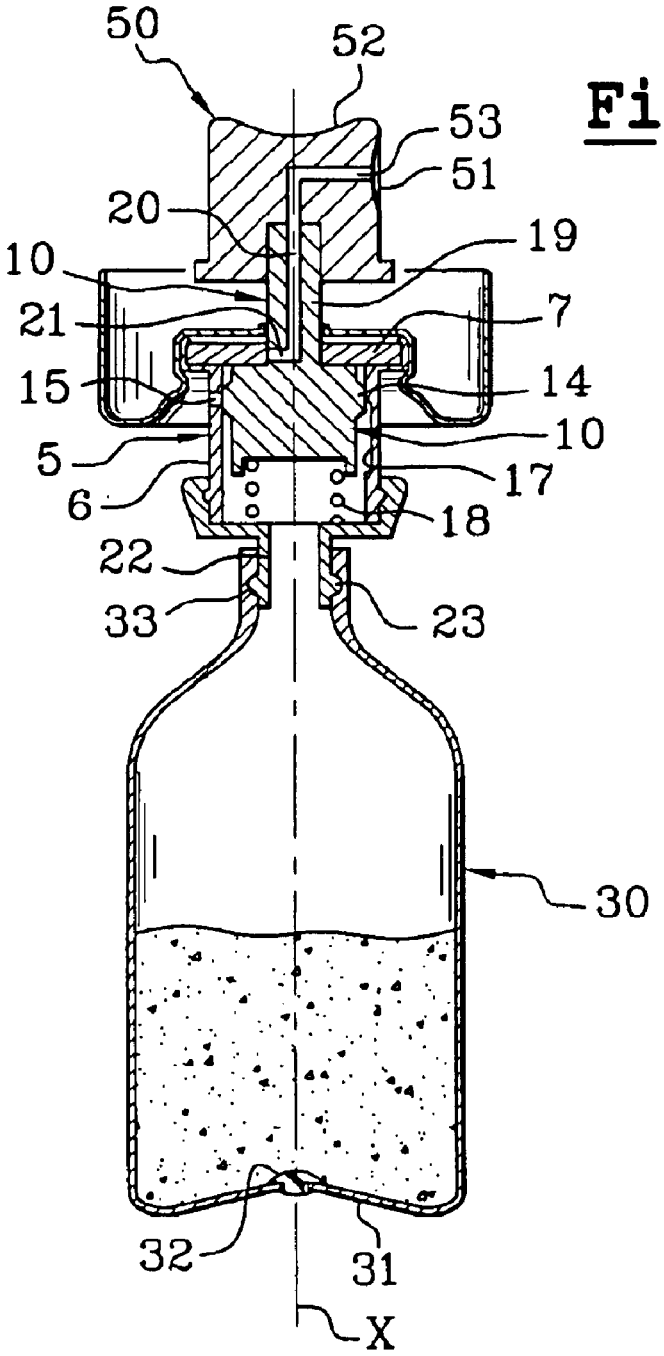

In FIG. 3C, the inner container 30 is mounted on the lower end of the valve body 6 by engaging the bulge 23 and the groove 33 of the inner container 30.

Figure 3D:
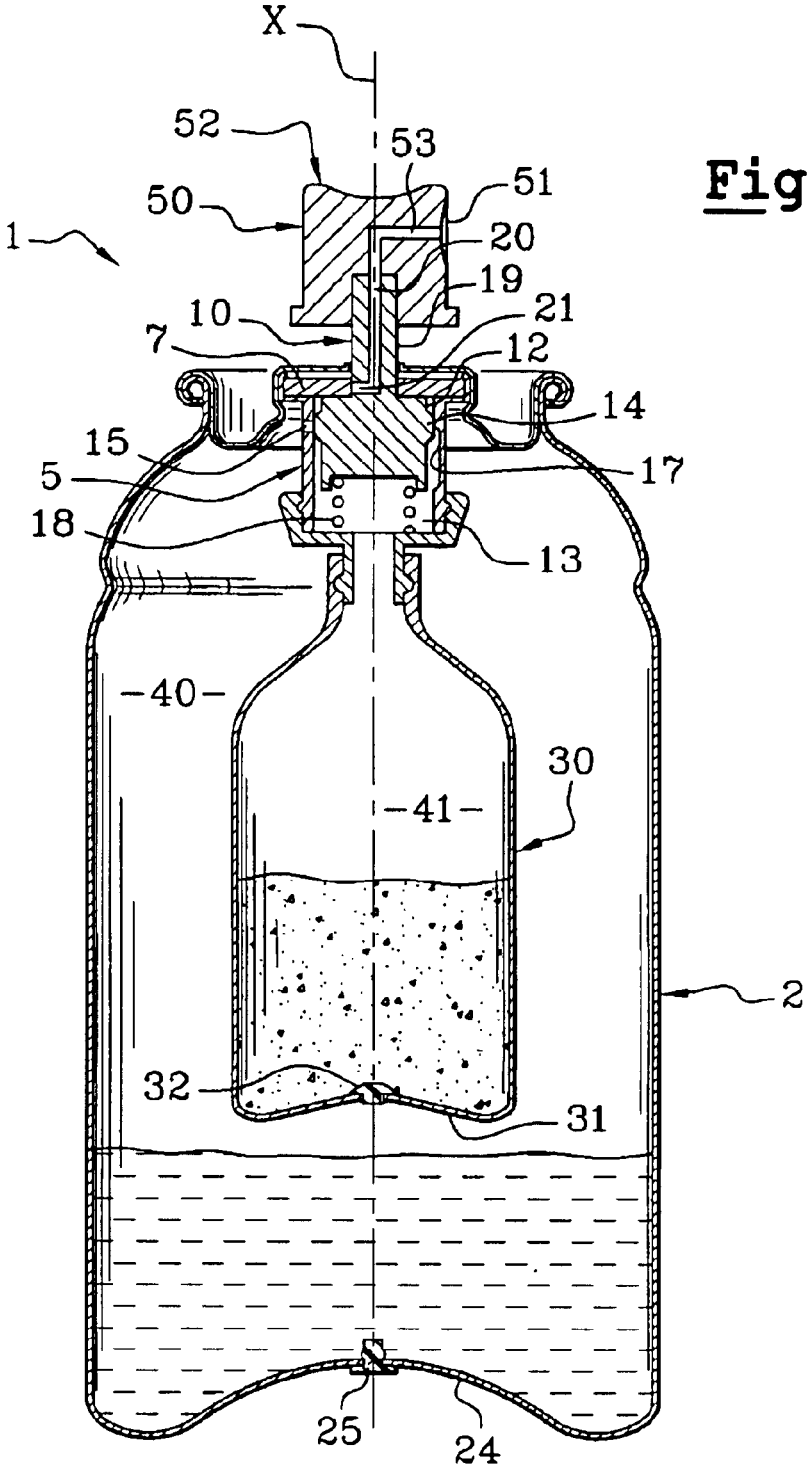

In FIG. 3D, the valve 5 equipped with the inner container 30 is expansion-rolled onto the open edge of the outer container 2. In this assembled position, it should be noted that the product level inside the first compartment 40 is away from the bottom 31 of the inner container 30.

Figure 3E:
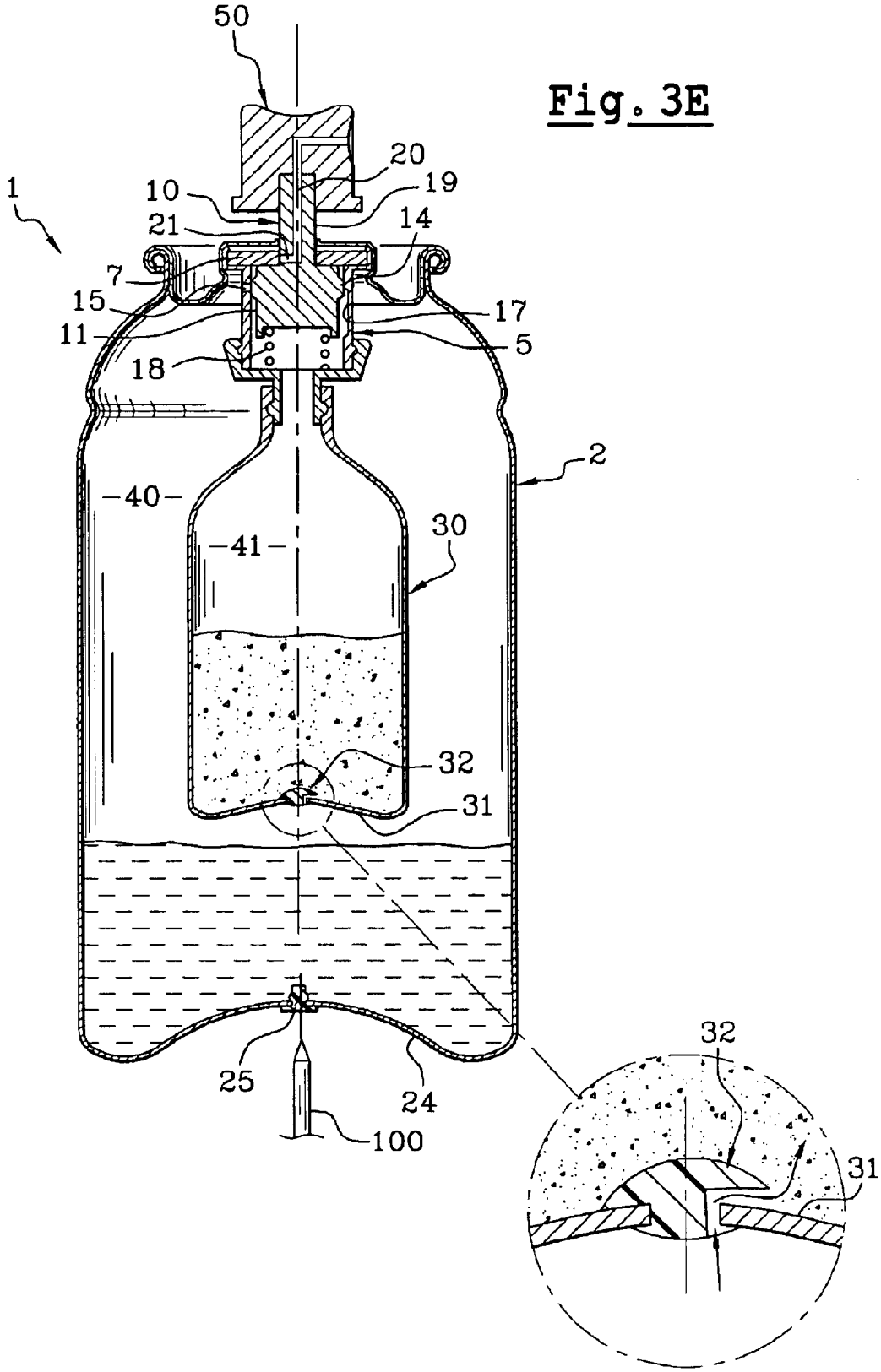

In FIG. 3E, a propellant (e.g., liquefied gas) is introduced into the first compartment 40 via the hollow needle 100 introduced into the rubber plug 25. In one example, the liquefied gas may comprise butane. Other propellants may also be used.

In the illustrated example, the free end of the needle 100 is arranged above the surface of the product in the first compartment 40 to avoid a bubbling phenomenon.

During this pressurizing step, the shutter 32 opens towards the inside of the inner container 30 to allow propellant gas to pass under the effect of the raised pressure inside the first compartment 40, by comparison with the pressure inside the second compartment 41. The shutter 32 remains open until the pressures are equalized. Once equilibrium is achieved, the shutter 32 closes again. This pressure equalizing mechanism may occur each time the pressure inside the second compartment 41 drops below the pressure in the first compartment 40.

The operation of the device will be described with reference to FIGS. 4A and 4B.

Figure 4B:
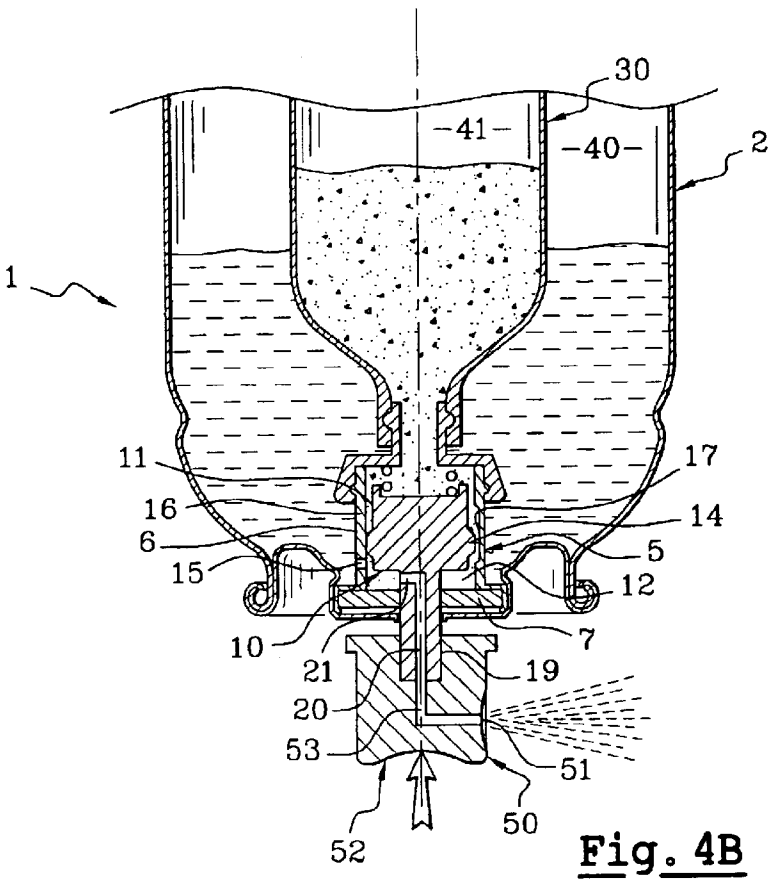
FIGS. 4A–4B are full and partial cross-sectional views illustrating the operation of the device of FIG. 1.
Figure 4A:
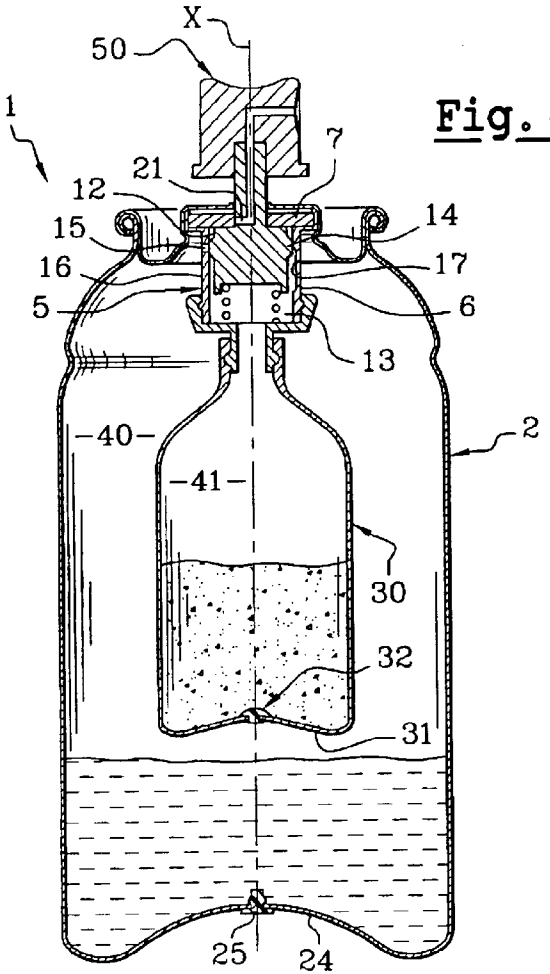

In FIG. 4A, the valve 5 is closed. The orifice 21 of the valve 5 is arranged facing the seal 7 of the valve 5. The annular bulge 14 faces the orifice 15 passing through the side wall 16 of the valve body 6, thus isolating the first compartment 40 from the valve body 6. The annular bulge 14, arranged above the upper end of the groove 17, isolates the lower part 13 of the valve body (and therefore the second compartment 41) from the upper part 12.

In FIG. 4B, once the can has been inverted into the head-down position, the user presses axially on the bearing surface 52. As she does this, the orifice 21 no longer faces the seal 7. As a result, the outlet passage 20 is in flow communication with the upper part 12 of the valve body 6. Likewise, the annular bulge 14 no longer faces the orifice 15 passing through the wall 16 of the valve body 6, thus providing communication between the product contained in the first compartment 40 and the outlet passage 20 via the orifice 21. Likewise, the annular bulge 14 is kept facing a portion of the groove 17, thus ensuring communication between the product contained in the second compartment 41 and the upper part 12 of the valve body 6. In this upper part, the two products mix and rise up, via the orifice 21, into the outlet passage 20 of the valve stem 19 then into the duct 53 of the dispensing head 50. The mixture is therefore dispensed in the form of a spray, a mousse or foam, a gel, or cream through the dispensing orifice 51. Mixtures of other forms may also be dispensed with the device of the present invention.

When the pressure on the bearing surface 52 is interrupted, the device returns to the configuration of FIG. 4A.

Figure 5:
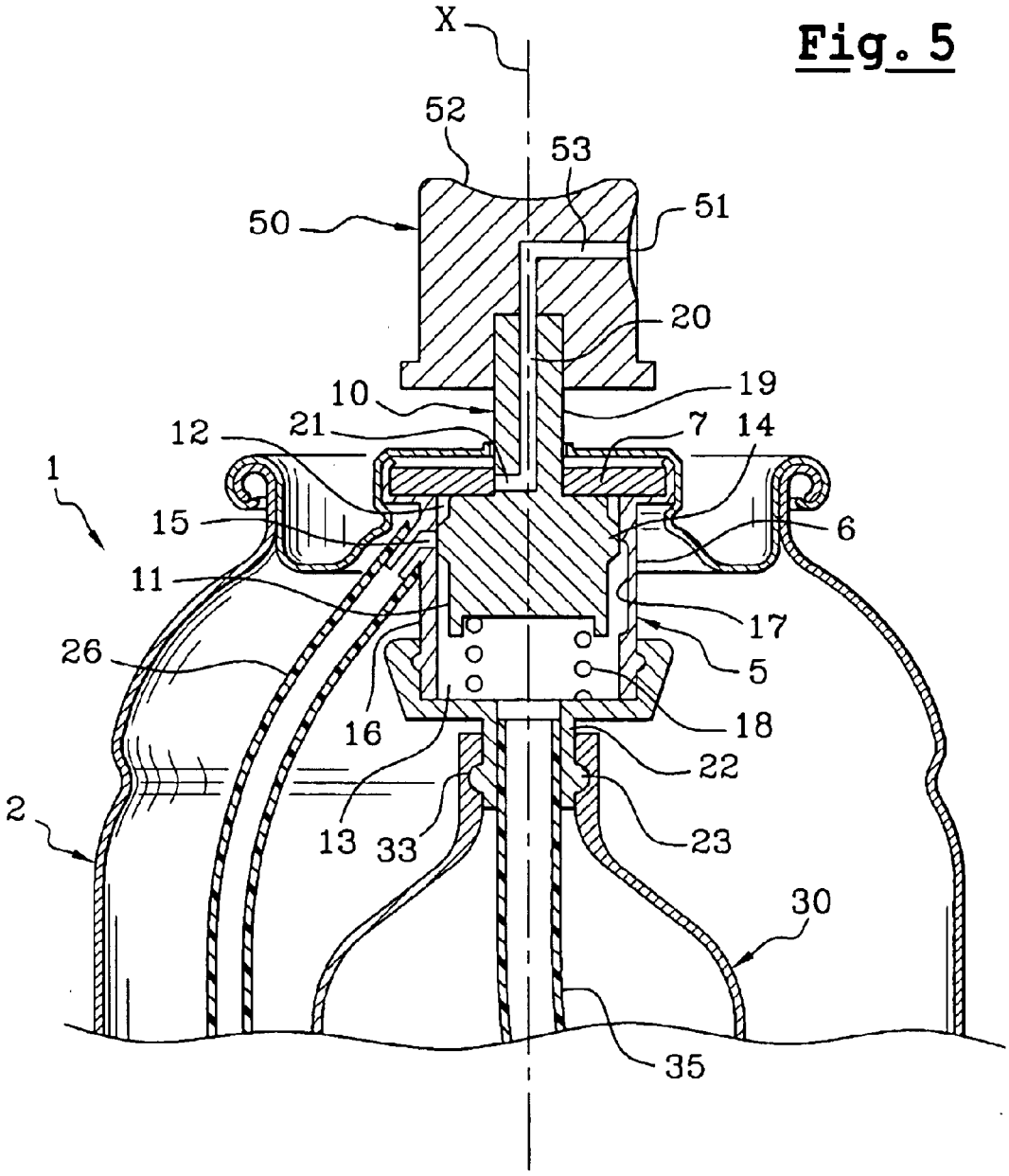
FIGS. 5 and 6A–6B are partial and full cross-sectional views of the device according to another exemplary embodiment of the invention.
Figure 6A:
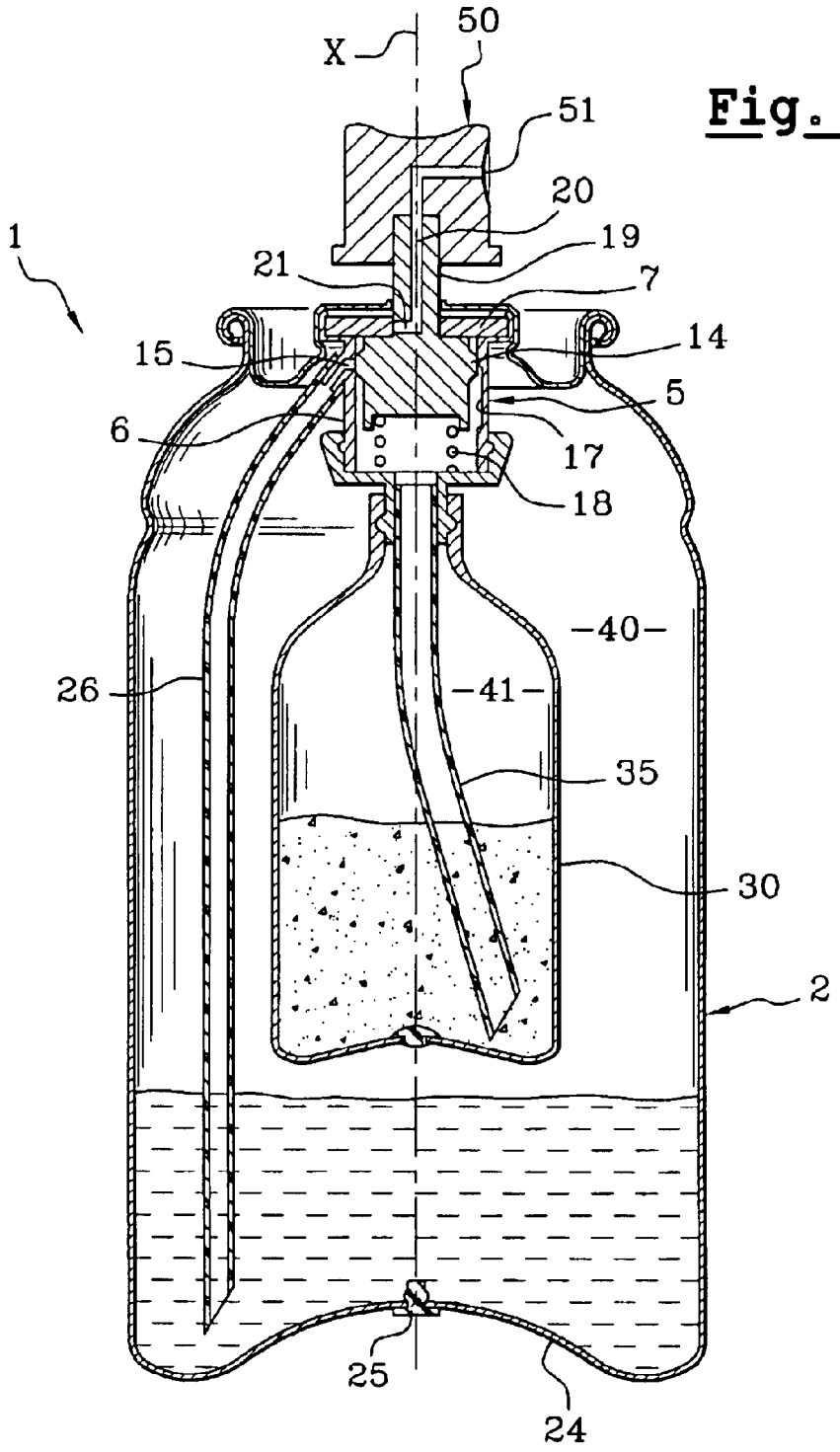
Figure 6B:
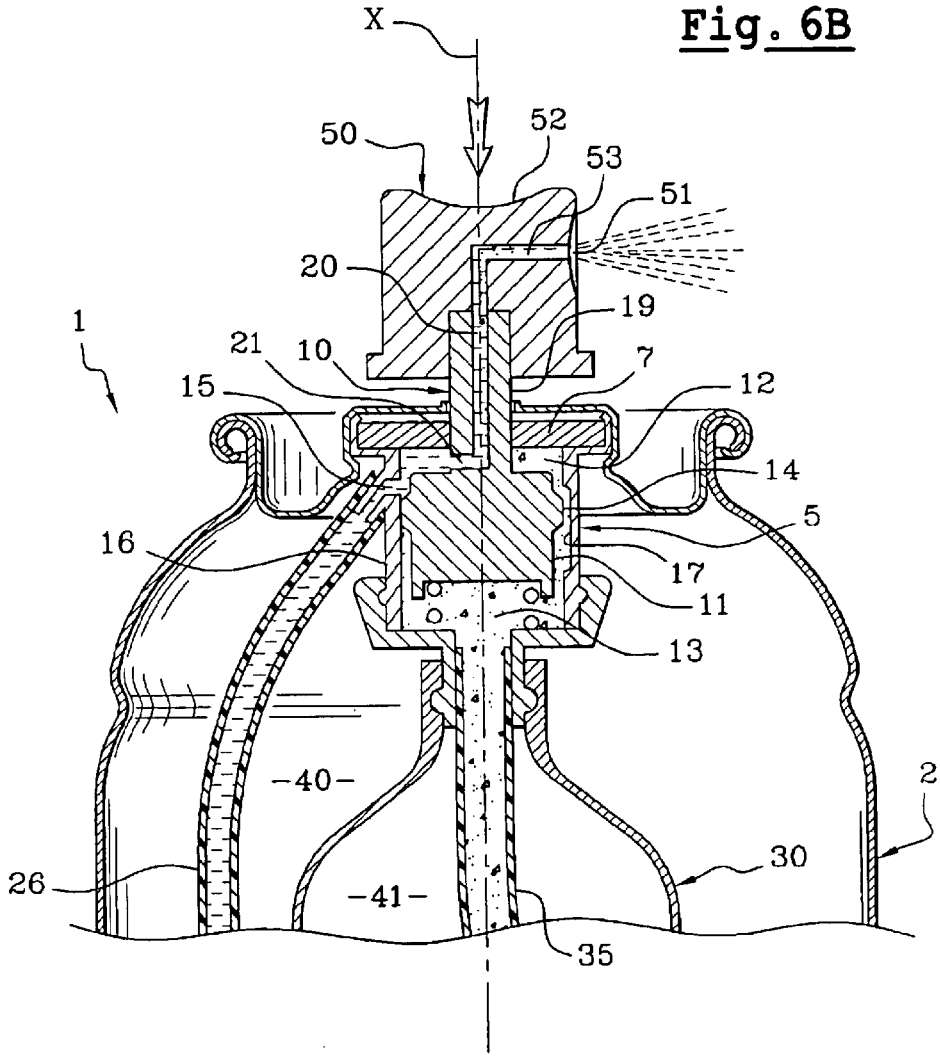
Figure 7:
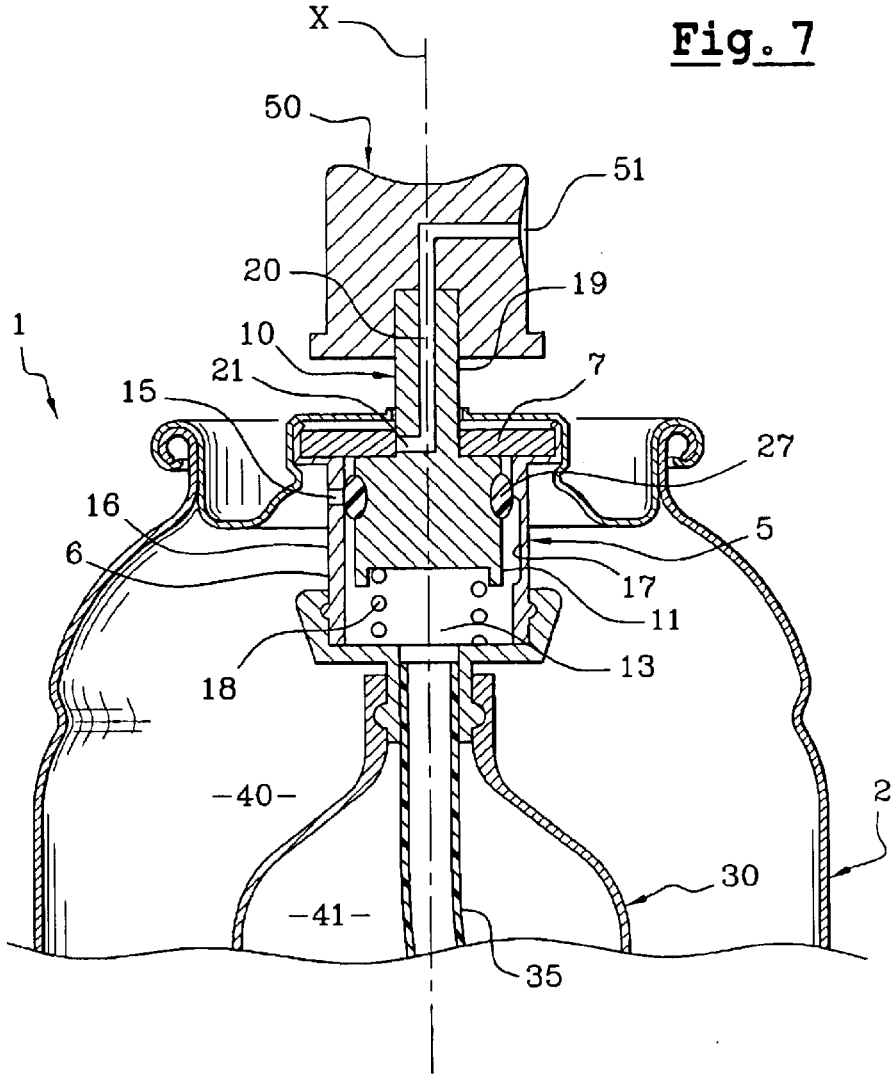
FIGS. 7 and 8A–8C are partial and full cross-sectional views illustrating the operation of the device according to another exemplary embodiment of the invention.

In the embodiment shown in FIGS. 5 and 6A–6B, the inner container 30 is equipped with a dip tube 35, a free end of which is proximate to the bottom of the inner container 30. The other end of the dip tube 35 is in flow communication with the axial hollow shaft 22 of the valve body 6.

Likewise, the outer container 2 is associated with a dip tube 26, one end of which is situated proximate to the bottom of the outer container 2. The other end of the dip tube is in flow communication with the orifice 15 made in the side wall of the valve body.

The assembly and filling of the device according to this embodiment is identical to the previously described embodiment.

The operation of the device in this embodiment is similar to that of the previously described embodiment, except that the device is used head up rather than head down.

Another embodiment of the device will now be described with reference to FIGS. 7 and 8A–8C.

In this embodiment, the portion of the piston 11 that performs sealing comprises an O-ring 27. The O-ring 27 may be attached to the piston or formed by two-shot injection molding or overmolding. Other forming techniques may also be used.

The inner container 30 comprises a dip tube 35, one end of which lies proximate to the bottom of the inner container 30. The other end of the dip tube 35 is in flow communication with the lower portion 13 of the valve body 6. The first compartment 40 formed on the outside of the inner container 30 has no dip tube.

The assembly and filling of the device are performed in an order similar to that described with reference to FIGS. 3A–3E. According to this embodiment, the product contained in the second compartment 41 is based on lactic or thioglycolic acid (e.g., perming reducing agent). The product contained in the first compartment 40 is based on hydrogen peroxide or bromide (e.g., fixing agent). Other products may also be used.

Figure 8A:
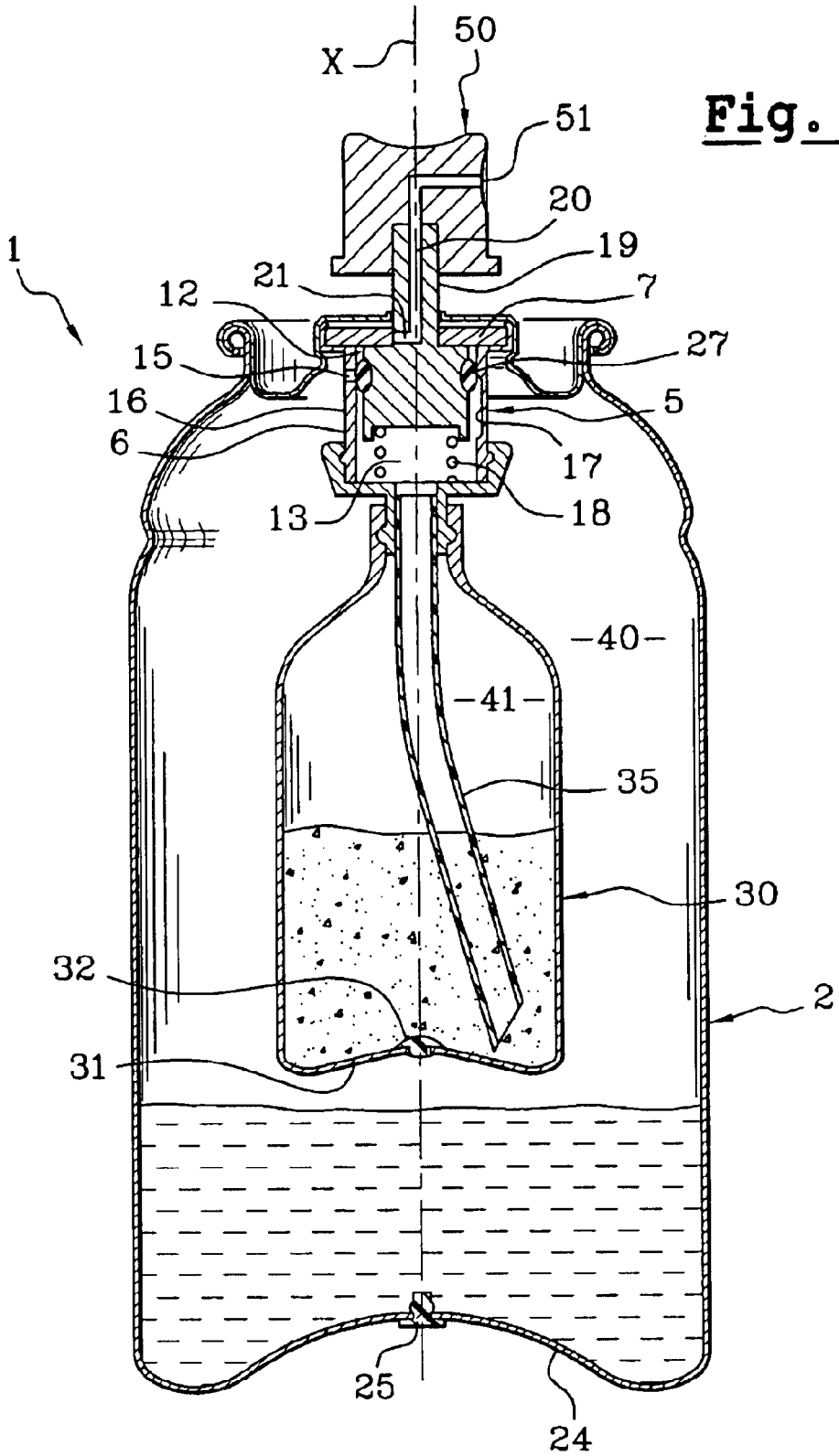

The device is shown ready for use in FIG. 8A, the valve 5 being in the closed position. The orifice 21 of the valve 5 is arranged facing the seal 7 of the valve 5. The O-ring 27 faces the orifice 15 passing through the side wall 16 of the valve body 6, thus isolating the first compartment 40 from the valve body 6. The O-ring 27, arranged above the upper end of the groove 17, isolates the lower part 13 of the valve body (and therefore the second compartment 41) from the upper part 12 of the valve body.

Figure 8B:
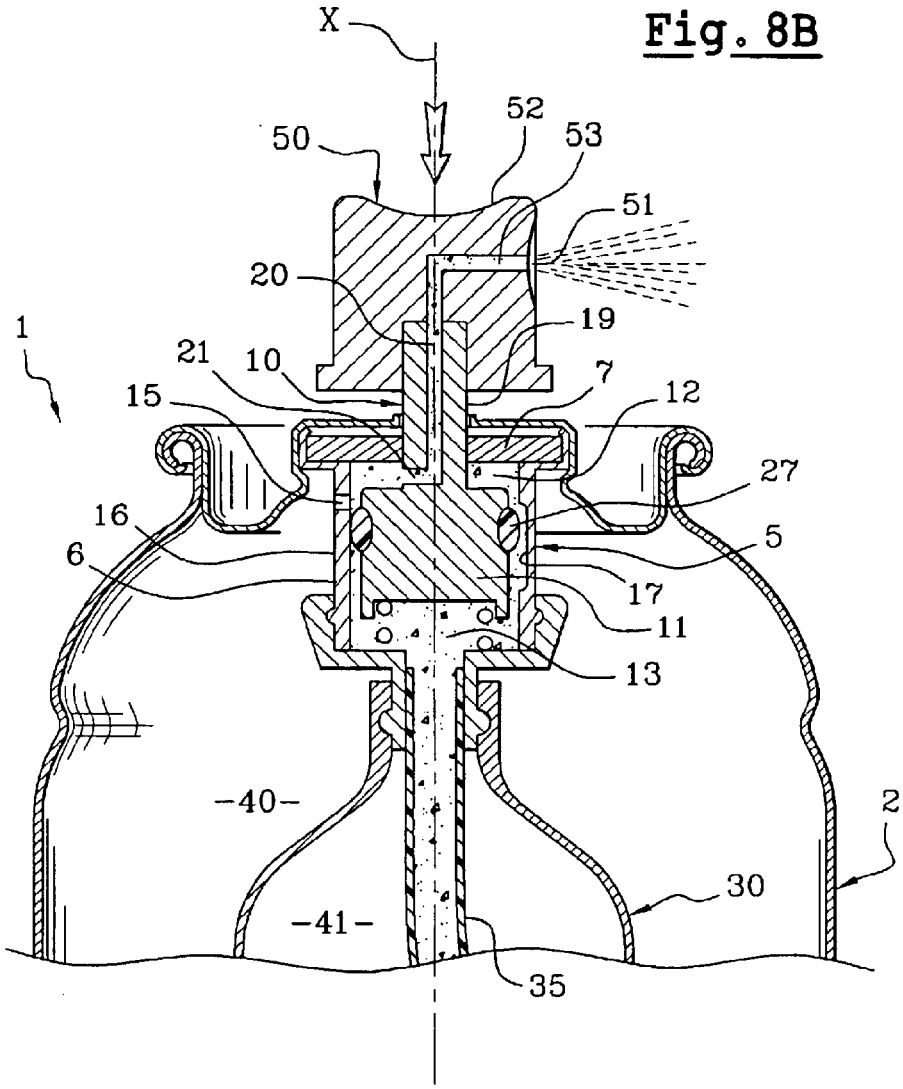

In FIG. 8B, holding the device in its head-up position, the user presses axially on the bearing surface 52. As she does this, the orifice 21 no longer faces the seal 7. The outlet passage 20 is in flow communication with the upper part 12 of the valve body 6. Likewise, the O-ring 27 no longer faces the orifice 15 passing through the wall 16 of the valve body 6, thus allowing flow communication between the first compartment 40 and the outlet passage 20 via the orifice 21. Furthermore, the O-ring 27 faces an upper portion of the groove 17, thus allowing flow communication between the lower part 13 of the valve body 6 (supplied with product via the dip tube 35) and the upper part 12 of the valve body 6. The perming reducing agent (mixed with propellant gas situated in the upper part of the first compartment 40) leaves the valve via the outlet passage 20, and then rises up inside the duct 53 in the dispensing head 50. The perming reducing agent is then dispensed through the dispensing orifice 51.

When the pressure on the bearing surface 52 is interrupted, the device returns to the configuration of FIG. 8A.

Figure 8C:
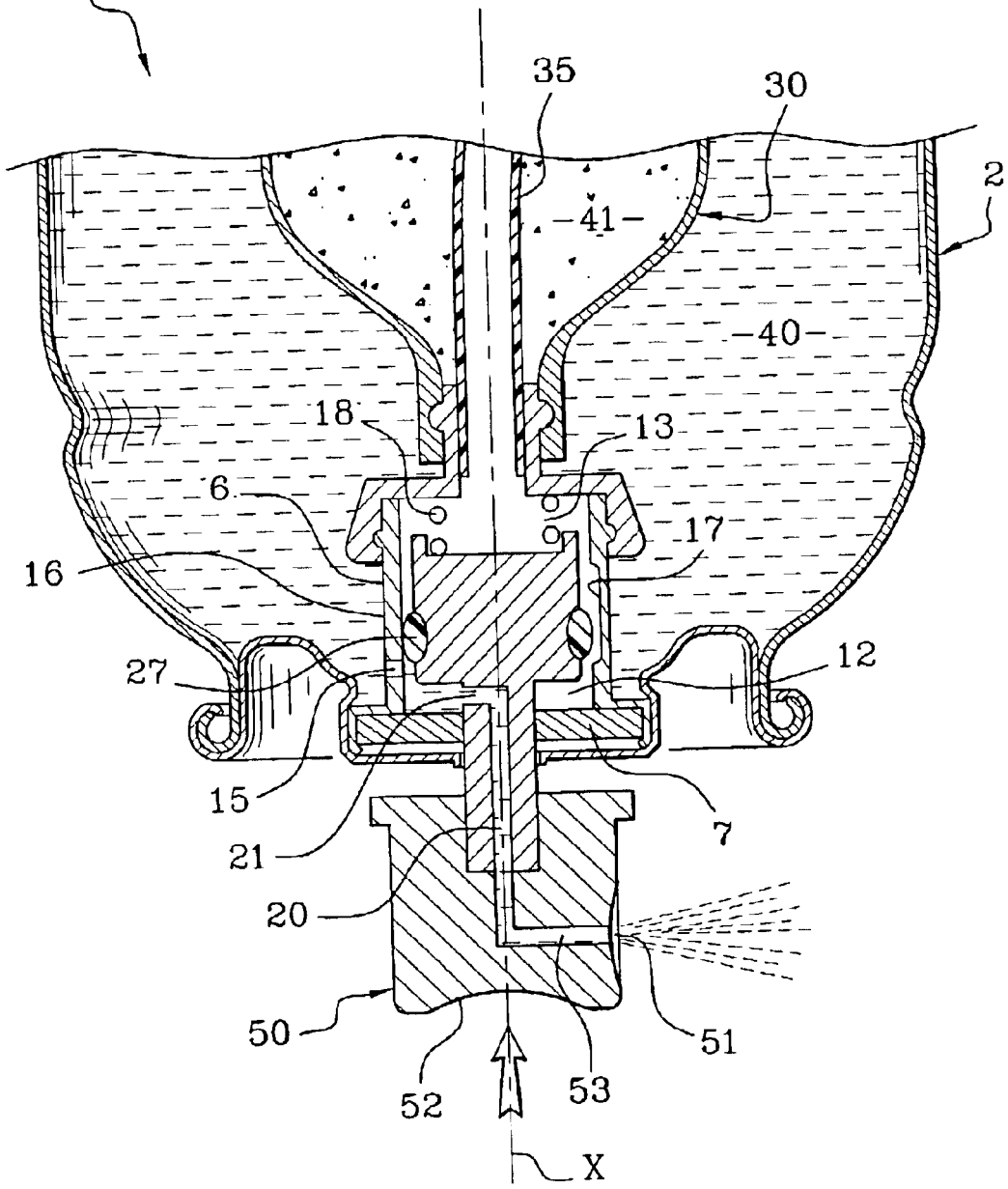
Figure 9:
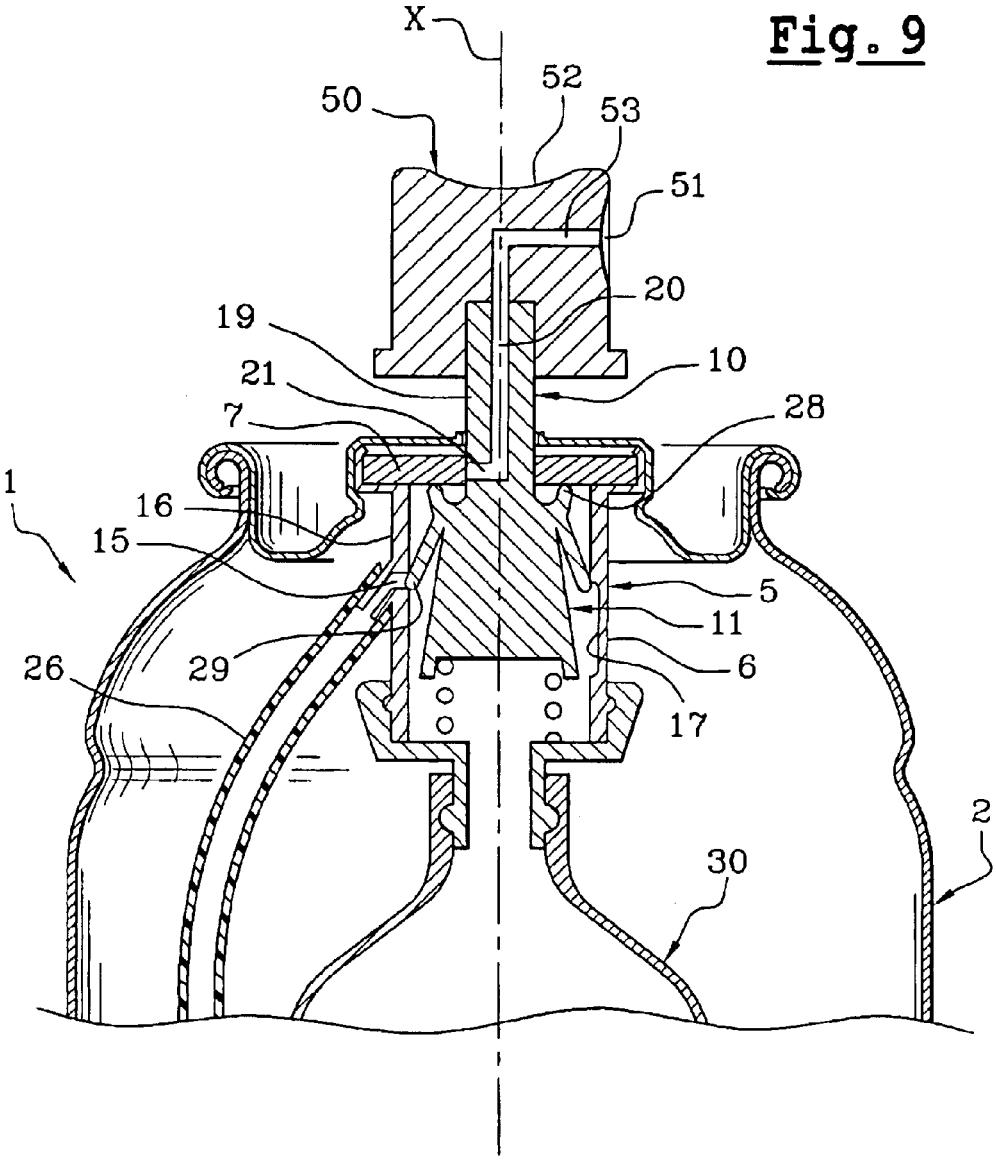
FIGS. 9 and 10A–10C are partial and full cross-sectional views illustrating the operation of the device according to another exemplary embodiment of the invention.
Figure 10A:
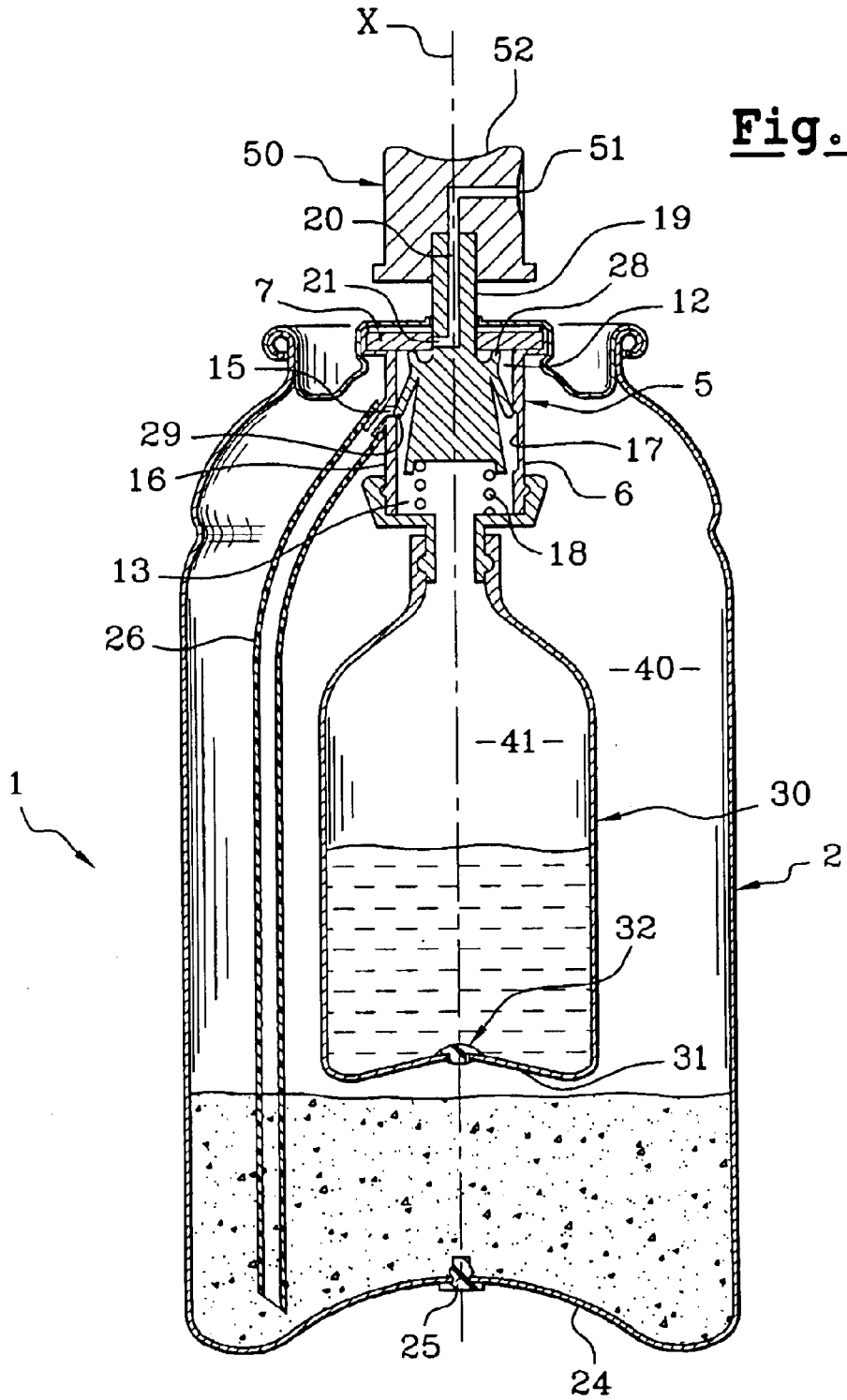
Figure 10B:
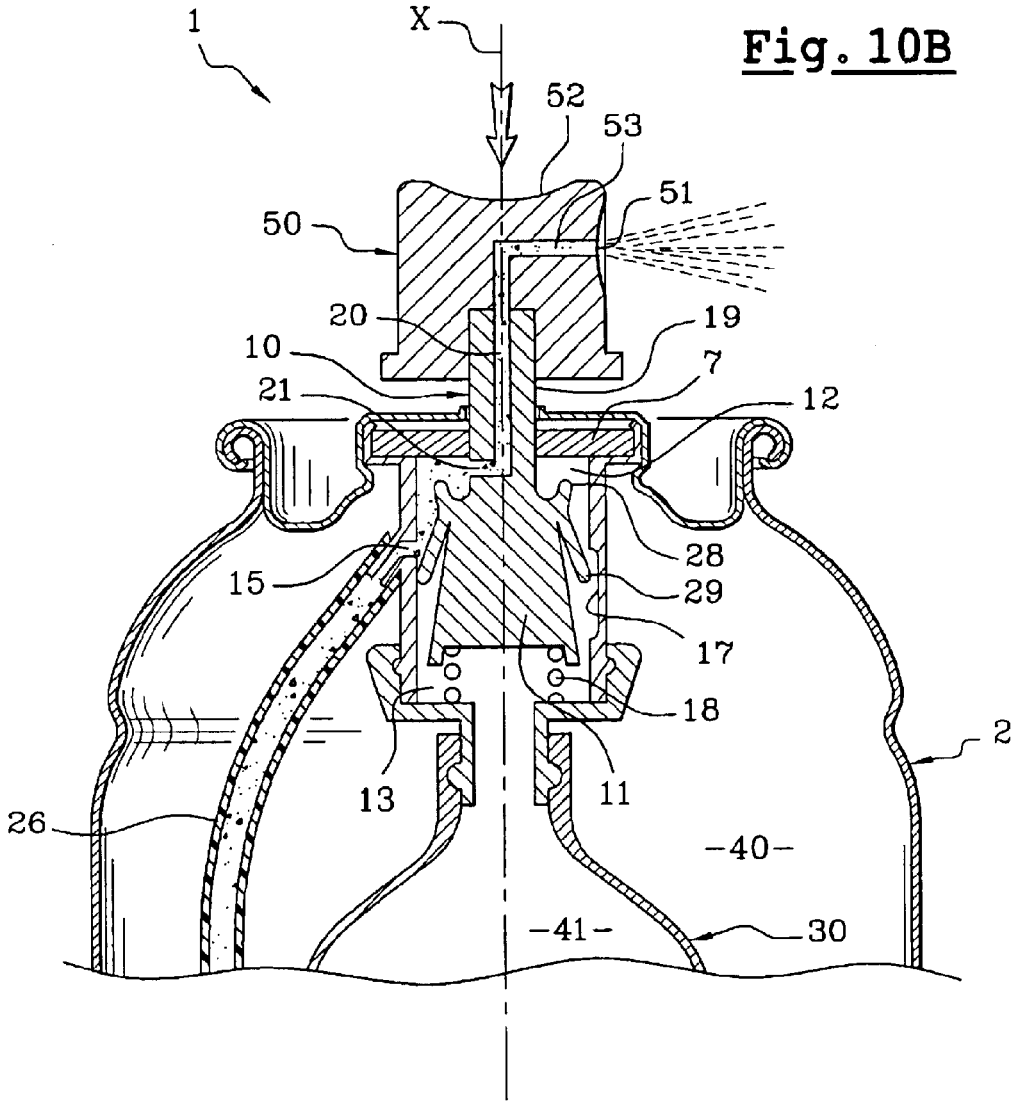
Figure 10C:
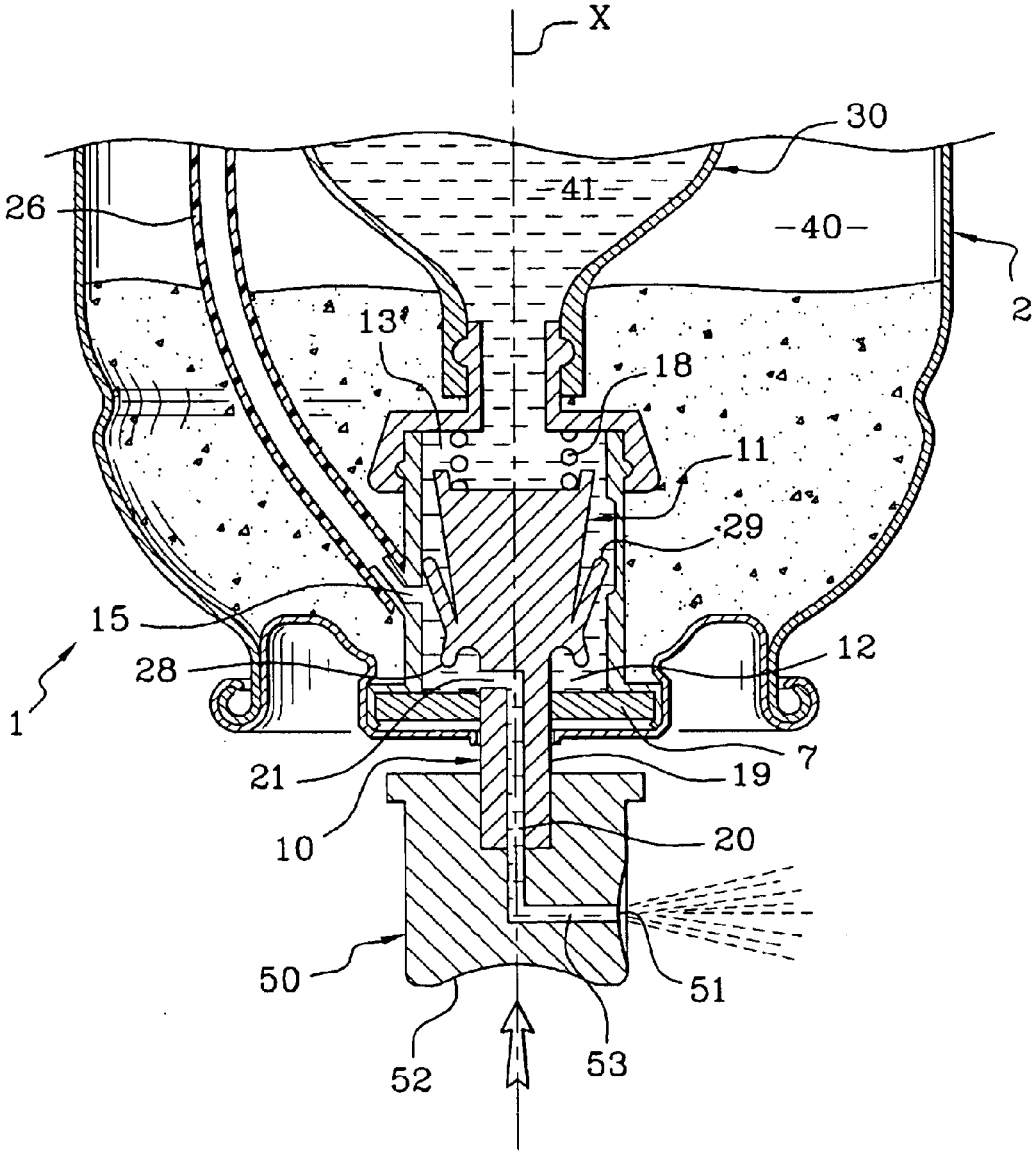

In the second phase, the user inverts the device 1 into the head-down position (FIG. 8C). She presses axially on the bearing surface 52. The orifice 21 no longer faces the seal 7. The outlet passage 20 is in flow communication with the upper part 12 of the valve body 6. Likewise, the O-ring 27 no longer faces the orifice 15 passing through the wall 16 of the valve body 6, thus allowing flow communication between the product contained in the first compartment 40 (fixing agent) and the outlet passage 20. In this position, the O-ring 27 faces an upper portion of the groove 17, thus allowing flow communication between the lower part 13 of the valve body 6 (supplied with propellant gas via the dip tube 35) and the upper part 12 of the valve body 6. The fixing agent (possibly mixed with propellant gas from the second compartment 41) leaves the valve via the orifice 21 and the outlet passage 20. It then rises up inside the duct 53 in the dispensing head 50. The fixing agent is then dispensed through the dispensing orifice 51.

When the pressure on the bearing surface 52 is interrupted, the device returns to the configuration of FIG. 8A.

Another embodiment of the device will now be described with reference to FIGS. 9 and 10A–10C.

In this embodiment, the piston 11 in the closed position is in engagement with the internal surface of the seal 7 of the valve body 6 via an annular ring 28, thus enhancing the sealing when closed.

Further, the inner container 30 has no dip tube. The outer container 2 is associated with a dip tube 26, one end of which lies proximate to the bottom 24 of the outer container 2. The other end of the dip tube 26 is in flow communication with the orifice 15 made in the side wall 16 of the valve body 6.

The portion of the piston 11 that is intended to make the seal comprises an annular lip 29 formed by a part attached to or overmolded onto the lower part of the nozzle. The annular lip 29 may be formed using other techniques.

The assembly and filling of the device are performed in an order similar to the one described with reference to FIGS. 3A–3E. According to this embodiment, the product contained in the outer container 2 is based on thioglycolic acid (perming reducing agent). The product contained in the inner container 30 is based on hydrogen peroxide (fixing agent). Other products may also be used.

In operation, the product dispensed in the first phase (FIG. 10B) is the product contained in the first compartment 40 (mixed with the gas contained in the second compartment 41). In the second phase (FIG. 10C), the product dispensed is the product contained in the second compartment 41 (mixed with the gas contained in the first compartment 40).

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A device comprising:

a first container;

a second container arranged at least partially inside the first container, wherein at least one of the first container and the second container defines a first compartment configured to contain a pressurized first product and a second compartment configured to contain a pressurized second product isolated from the first product;

a dispensing valve comprising an outlet, the dispensing valve being configured to be actuated and being configured to selectively enable at least one of the first product and the second product to flow to the outlet in response to actuation of the dispensing valve; and a one-way valve disposed between the first compartment and the second compartment, wherein the device is configured so that the first product and the second product lack contact with one another in the first compartment and in the second compartment during flow of said at least one of the first product and the second product to the outlet.

2. The device of claim 1, wherein the one-way valve is associated with the second container.

3. The device of claim 1, wherein the one-way valve is configured to permit flow into the second compartment.

4. The device of claim 1, wherein the first container comprises an orifice associated with a closure configured to permit pressurization of the first compartment and pressurization of the second compartment via the one-way valve.

5. The device of claim 4, wherein the closure comprises an elastomer plug.

6. The device of claim 1, wherein the one-way valve comprises a shutter.

7. The device of claim 6, wherein the shutter comprises an elastically deformable material.

8. The device of claim 7, wherein the elastically deformable material is chosen from thermoplastics and cross-linked elastomers.

9. The device of claim 1, wherein the dispensing valve is configured to permit the outlet to be substantially simultaneously in flow communication with both the first compartment and the second compartment.

10. The device of claim 1, wherein the dispensing valve is configured to enable both the first product and the second product to flow to the outlet substantially simultaneously.

11. The device of claim 1, wherein the dispensing valve is configured to enable one of the first product and the second product to flow to the outlet.

12. The device of claim 1, wherein the dispensing valve is flow coupled to a dip tube comprising a free end arranged proximate to a bottom of the first container.

13. The device of claim 12, wherein the dip tube is a first dip tube, and wherein the dispensing valve is flow coupled to a second dip tube comprising a free end arranged proximate to a bottom of the second container.

14. The device of claim 1, wherein the dispensing valve comprises an actuatable element configured to move between a first position and a second position in response to an actuating force.

15. The device of claim 14, wherein the dispensing valve is configured so that when the actuatable element is in the first position, the outlet is sealed off from the first compartment and the second compartment, and, when the actuatable element is in the second position, the outlet is in flow communication with the first compartment and the second compartment.

16. The device of claim 15, wherein the dispensing valve is configured so that as the actuatable element is moved from the first position to the second position, the outlet is simultaneously or successively placed in flow communication with the first compartment and the second compartment.

17. The device of claim 14, wherein the dispensing valve further comprises a valve body and wherein the actuatable element comprises a piston configured to slide axially inside the valve body, the piston separating a first axially portion of the valve body from a second axial portion of the valve body.

18. The device of claim 17, wherein the second axial portion of the valve body is in flow communication with the second compartment.

19. The device of claim 17, wherein the dispensing valve is configured so that when the actuatable element is in the first position, the first axial portion of the valve body and the second axial portion of the valve body are sealed off from one another.

20. The device of claim 17, wherein the piston is secured to a valve stem comprising at least a portion extending from the valve body.

21. The device of claim 20, wherein the outlet comprises an outlet passage passing through the valve stem.

22. The device of claim 20, wherein the outlet comprises an outlet orifice at an end of the valve stem.

23. The device of claim 17, wherein the dispensing valve is configured so that when the actuatable element is in the first position, a sealing element associated with the piston seals off at least one orifice passing through a wall of the valve body and opening into the first compartment.

24. The device of claim 23, wherein the dispensing valve is configured so that when the actuatable element is in the first position, the sealing element further seals off the first axial portion of the valve body from the second axial portion of the valve body.

25. The device of claim 23, wherein the sealing element comprises at least one of a lip and a seal.

26. The device of claim 23, wherein the dispensing valve is configured so that when the actuatable element is in the second position, the at least one orifice passing through the wall of the valve body is uncovered so as to allow flow communication between the first axial portion of the valve body and the first compartment.

27. The device of claim 26, wherein the dispensing valve is configured so that when the actuatable element is in the second position, the first axial portion of the valve body and the second axial portion of the valve body are in flow communication.

28. The device of claim 27, wherein the dispensing valve is configured so that when the actuatable element is in the second position, the first axial portion of the valve body and the second axial portion of the valve body communicate via at least one axial groove formed in an internal wall of the valve body.

29. The device of claim 1, further comprising an actuator configured to actuate the dispensing valve.

30. The device of claim 29, wherein the actuator comprises at least one orifice configured to dispense, separately or as a mixture, the first product and the second product.

31. The device of claim 30, wherein the actuator comprises a push button.

32. The device of claim 1, wherein the first container and the second container comprise metal.

33. The device of claim 32, wherein the metal is chosen from tin plate and aluminum.

34. The device of claim 1, wherein the first container and the second container comprise a thermoplastic material.

35. The device of claim 34, wherein the thermoplastic material is chosen from polyvinyl chloride, polyethylene terephthalate, and a polyethylene terephthalate/polyethylene naphthalate blend.

36. The device of claim 1, wherein the dispensing valve is mounted on the first container.

37. The device of claim 36, wherein the dispensing valve is mounted on the first container by at least one of crimping and expansion rolling.

38. The device of claim 1, wherein the second container is secured to the dispensing valve.

39. The device of claim 38, wherein the second container is secured to the dispensing valve by at least one of bonding, welding, snap-fastening, and crimping.

40. The device of claim 1, wherein the first compartment is defined by the first container and the second container, and the second compartment is defined by the second container.

41. The device of claim 40, wherein the one-way valve is configured to permit flow into the second compartment.

42. The device of claim 40, wherein the first compartment surrounds the second container over at least part of its height.

43. The device of claim 1, further comprising a first product in the first compartment and a second product in the second compartment.

44. The device of claim 43, wherein a free surface of the first product is spaced from the one-way valve when the device is in a head-up position.

45. The device of claim 43, wherein at least one of the first product, the second product, and a mixture of the first and second products comprises a cosmetic product.

46. The device of claim 43, wherein one of the first and second products comprises a dye, the other of the first and second products comprises an oxidizing agent, and a mixture of the first and second products comprises a hair dye product.

47. The device of claim 43, wherein one of the first and second products comprises a permanent wave reducing agent and the other of the first and second products comprises a permanent wave fixing agent.

48. The device of claim 43, wherein the first product in the first compartment is pressurized and the second product in the second compartment is pressurized.

49. The device of claim 48, further comprising propellant in the first compartment pressurizing the first product and propellant in the second compartment pressurizing the second product.

50. The device of claim 48, wherein pressure of the first product in the first compartment is substantially the same as or higher than pressure of the second product in the second compartment.

51. The device of claim 1, wherein the device is configured so that when the device is in a head-up position, one of the first and second products passes to the outlet in response to actuation of the dispensing valve, and when the device is in a head-down position, the other of the first and second products passes to the outlet in response to actuation of the dispensing valve.

52. The device of claim 1, wherein the device is configured so that when the device is in at least one of a head-up position and a head-down position, both the first and second products pass to the outlet in response to actuation of the dispensing valve.

53. A method for packaging at least two products, comprising:

providing the device of claim 1;

placing a first product into the first compartment;

placing a second product into the second compartment; and pressurizing the first compartment and the second compartment via one of the first compartment and the second compartment.

54. The method of claim 53, wherein the pressurizing comprises introducing propellant into the first container, wherein the propellant passes from the first container to the second container via the one-way valve.

55. A method of dispensing, comprising:

providing the device of claim 43; and actuating the dispensing valve so as to dispense at least one of the first product and the second product.

56. The method of claim 55, further comprising dispensing both the first product and the second product substantially simultaneously.

57. The method of claim 55, further comprising dispensing one of the first product and the second product, and dispensing the other of the first product and the second product.

58. The method of claim 55, further comprising:

dispensing one of the first product and the second product; and dispensing the other of the first product and the second product after at least some of said one of the first product and second product has been dispensed.

59. The method of claim 55, wherein one of the first product and the second product comprises a dye, the other of the first product and the second product comprises an oxidizing agent, and a mixture of the first and second products comprises a hair dye product.

60. The method of claim 55, wherein one of the first product and the second product comprises a permanent wave reducing agent and the other of the first product and the second product comprises a permanent wave fixing agent.

61. The method of claim 60, wherein at least a portion of the permanent wave reducing agent is dispensed before the permanent wave fixing agent.

62. The method of claim 55, wherein at least one of the first product, the second product, and a mixture of the first and second products comprise a cosmetic product, and wherein the method comprises dispensing the cosmetic product.

63. The method of claim 62, further comprising dispensing the cosmetic product onto at least one of hair, skin, a finger nail, and a toe nail.

64. The method of claim 62, further comprising dispensing the cosmetic product onto an applicator and applying the cosmetic product to at least one of hair, skin, a finger nail, and a toe nail using the applicator.

* * * * *

UNITED STATES PATENT AND TRADEMARK OFFICE

CERTIFICATE OF CORRECTION

PATENT NO. : 6,920,904 B2
DATED : July 26, 2005
INVENTOR(S) : Jean-Pierre Yquel

It is certified that error appears in the above-identified patent and that said Letters Patent is hereby corrected as shown below:

Title page,
Item [75], Inventors, "Jean-Pierr Yquel" should read -- Jean-Pierre Yquel --.

Column 12,
Line 37, "axially" should read -- axial --.

Signed and Sealed this

Twentieth Day of September, 2005

JON W. DUDAS
*Director of the United States Patent and Trademark Office*